US005233945A

United States Patent [19]

Wolf et al.

[11] Patent Number: 5,233,945

[45] Date of Patent: Aug. 10, 1993

[54] PORTABLE HANDHELD WORK APPARATUS

[75] Inventors: Günter Wolf, Oppenweiler; Reinhold Fink, Fellbach; Rudolf Dirks, Weinstadt, all of Fed. Rep. of Germany

[73] Assignee: Andreas Stihl, Waiblingen, Fed. Rep. of Germany

[21] Appl. No.: 901,156

[22] Filed: Jun. 19, 1992

[30] Foreign Application Priority Data

Jun. 21, 1991 [DE] Fed. Rep. of Germany ..... 4120874

[51] Int. Cl.[5] ..... F01P 1/02

[52] U.S. Cl. ..... 123/41.7; 30/381

[58] Field of Search ..... 30/381; 123/41.56, 41.69, 123/41.7, 198 E

[56] References Cited

U.S. PATENT DOCUMENTS 4,835,866 6/1989 Nagashimo ..... 30/381

5,018,492 5/1991 Wolf et al. ..... 30/381

*Primary Examiner*—Noah P. Kamen

*Attorney, Agent, or Firm*—Walter Ottesen

[57] ABSTRACT

The invention relates to a portable handheld work apparatus such as a motor-driven chain saw having an internal combustion engine, a fuel tank and an apparatus housing. The engine has a crankcase and at least one cylinder. The fuel tank is attached to the crankcase at a distance by means of two flanges whereby a mounting space is provided between the flanges, the crankcase and the fuel tank. This mounting space accommodates necessary components of the work apparatus and is closed by cover plates attached to the crankcase and the fuel tank or on the flanges.

12 Claims, 5 Drawing Sheets

PORTABLE HANDHELD WORK APPARATUS

FIELD OF THE INVENTION

The invention relates to a portable handheld work apparatus such as a motor-driven chain saw which includes a crankcase, an internal combustion engine comprising at least one cylinder, a fuel tank as well as an apparatus housing.

BACKGROUND OF THE INVENTION

It is known to provide work apparatus having an internal combustion engine for driving the same with an apparatus housing wherein, in addition to the engine, additional components are mounted which are necessary for the operation of the apparatus.

SUMMARY OF THE INVENTION

It is an object of the invention to provide a portable handheld work apparatus which includes an apparatus housing that is compact and is convenient with respect to service.

The portable handheld work apparatus of the invention is, for example, a motor-driven chain saw and includes: an internal combustion engine having a crankcase and at least one cylinder; a fuel tank; two flanges separated from each other by a predetermined spacing for attaching the fuel tank to the crankcase to define an apparatus housing and so as to cause the fuel tank, the crankcase and the flanges to conjointly define a mounting space; and, cover plates attached to the housing for at least partially closing the mounting space.

The mounting space is provided by the connection of the fuel tank by means of flanges to the crankcase of the engine utilized as a drive motor. The flanges are preferably configured as a unit with the fuel tank. The mounting space accommodates further components for operating the work apparatus and is easily accessible thereby facilitating service. The apparatus housing can as a unit be configured to be compact since the crankcase itself defines the forward portion of the apparatus housing. The lateral cover plates are, on the one hand, connected to the tank housing and, on the other hand, to the crankcase and thereby impart a high rigidity to the modularly-configured apparatus housing.

The apparatus housing according to the invention is advantageously provided for top-handle machines wherein a handle aligned in the longitudinal direction of the work apparatus is attached with its forward end portion to the crankcase and with its rearward end portion to the tank housing. Because of the compact apparatus housing, the center of gravity can lie below the handle which makes the work apparatus user friendly, so that an optimal operation of the top-handle machine is provided.

The configuration of the invention provides a releasable connection between a tank housing made of plastic and a crankcase manufactured of a magnesium alloy.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
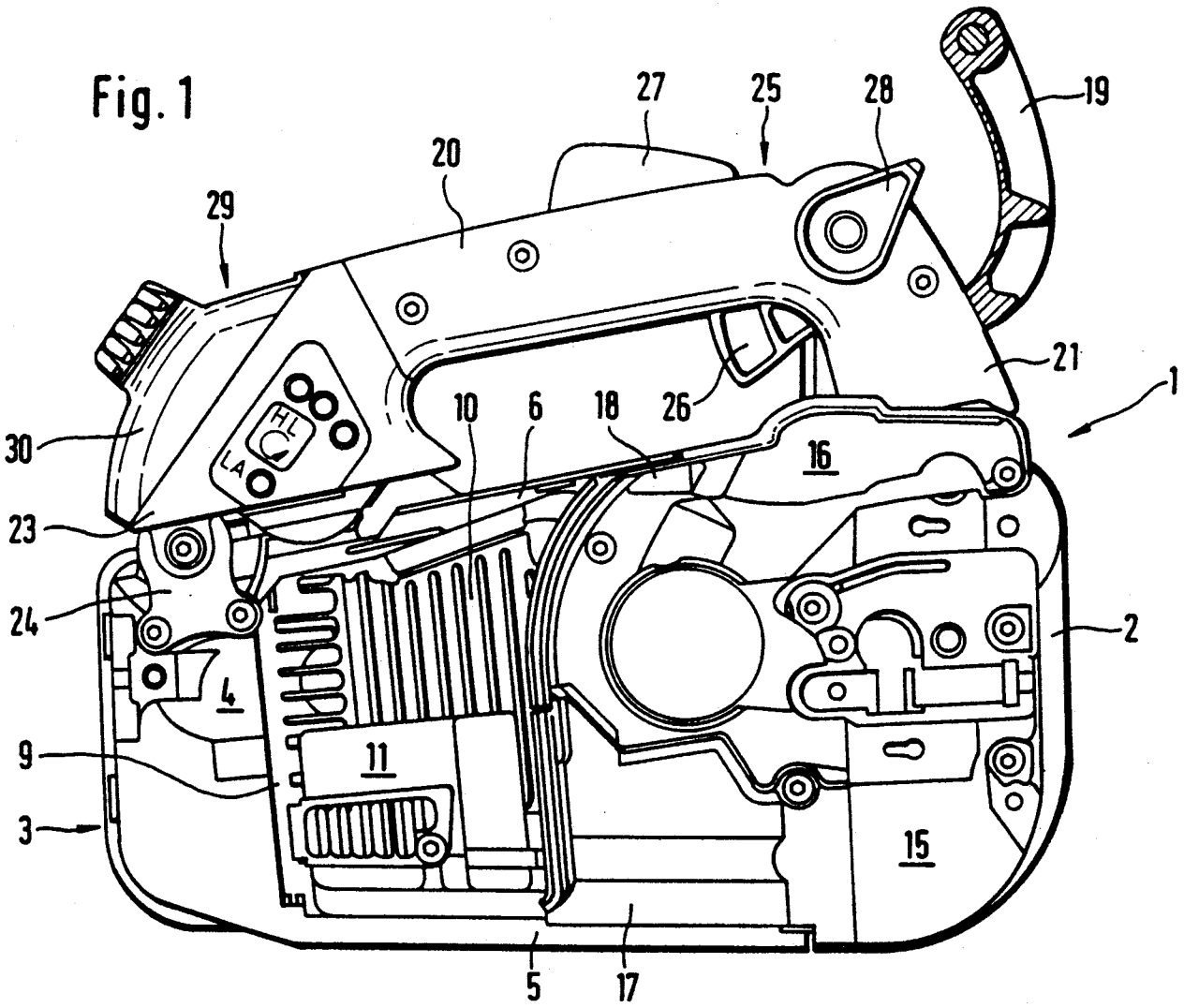
FIG. 1 is a side elevation view of a motor-driven chain saw with the sprocket cover removed.

The motor-driven chain saw shown in FIG. 1 is a top-handle machine having an apparatus housing assembled in a modular-like manner.

Figure 2:
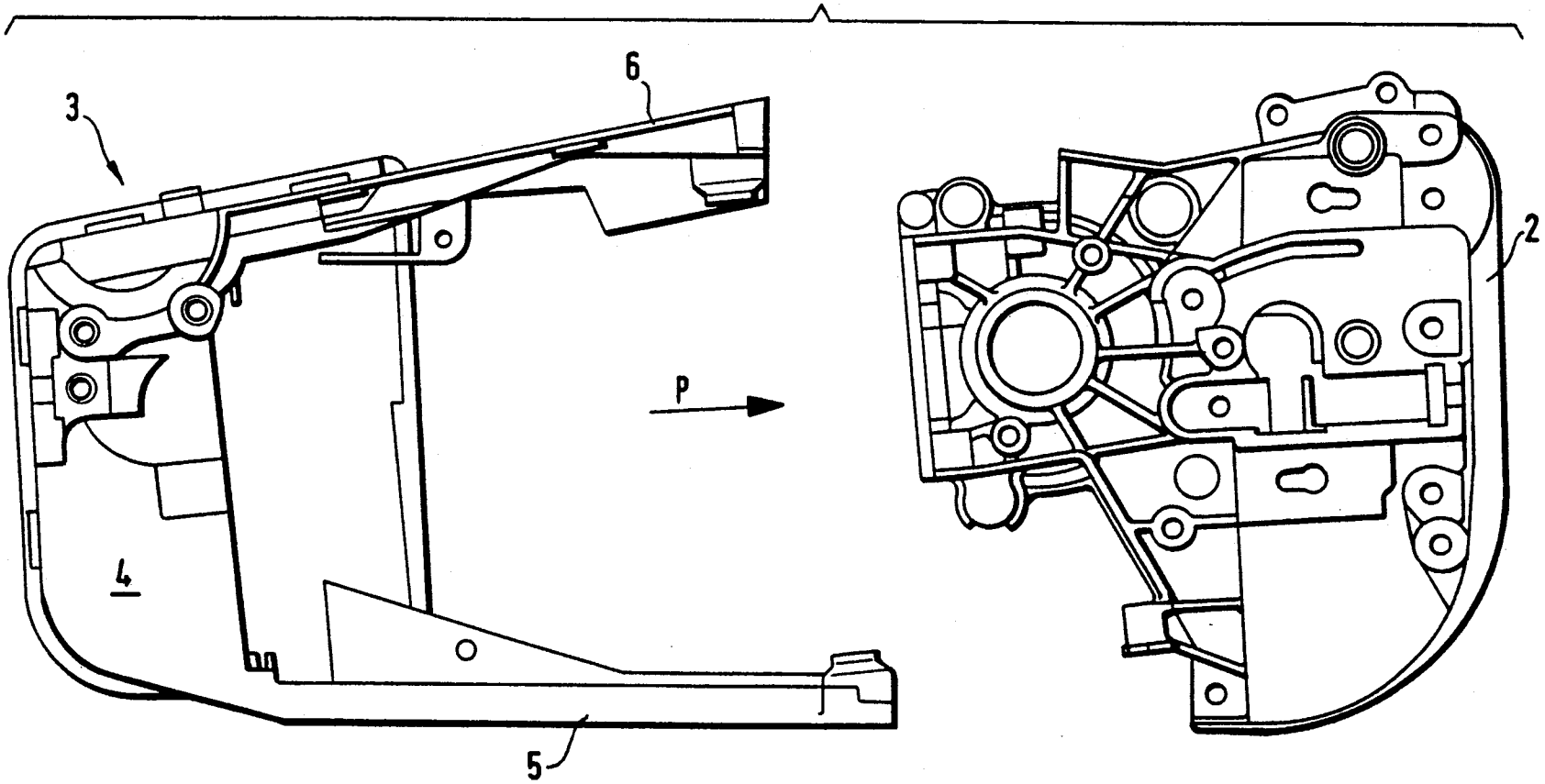
FIG. 2 shows a side elevation view of a crankcase and a tank housing which are shown ready to be joined in the direction of arrow P.
Figure 3:
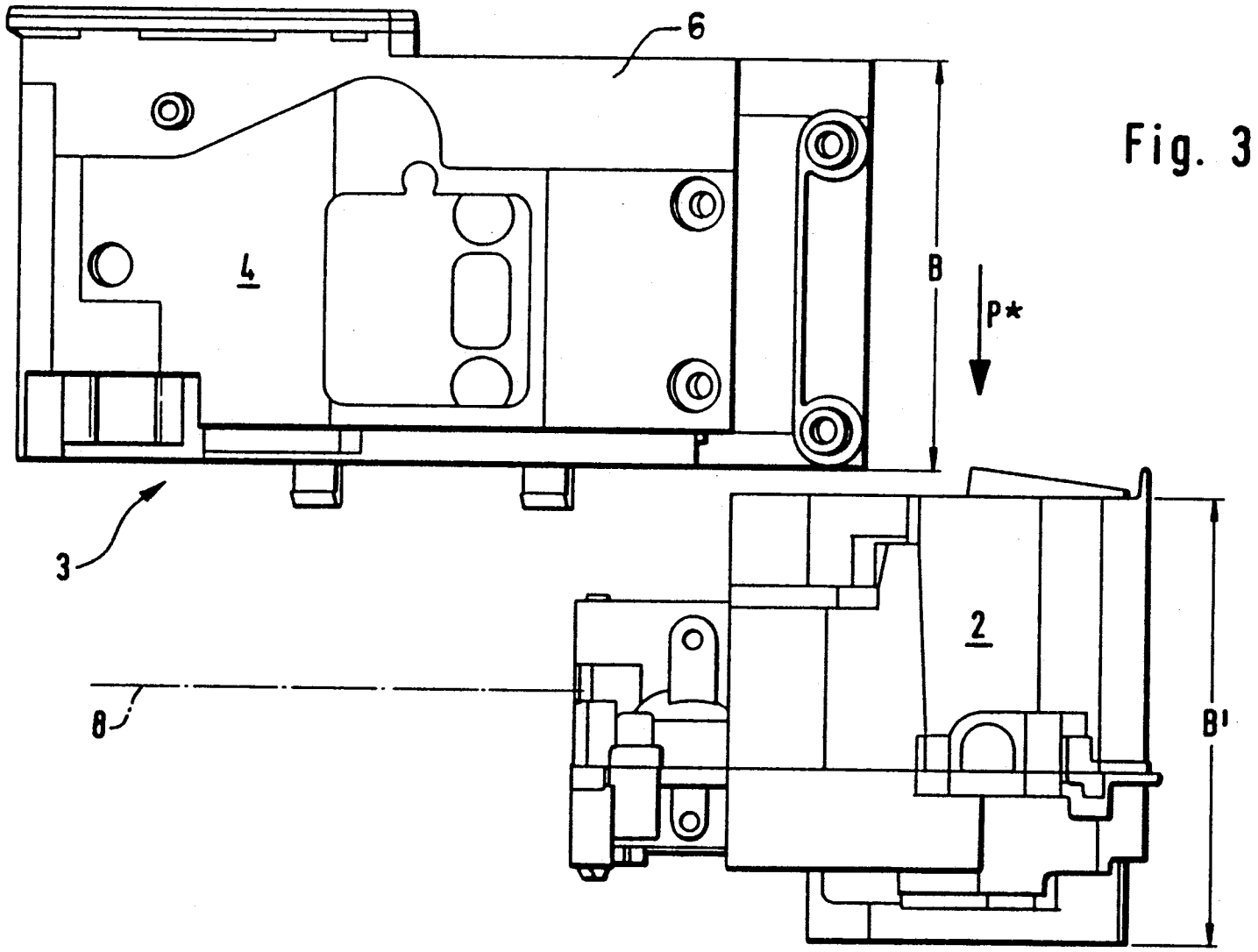
FIG. 3 is a plan view of a crankcase and a tank housing positioned for joining in the direction of arrow P*.

As shown in FIGS. 2 and 3, the apparatus housing 1 is essentially defined by the crankcase 2 of an internal combustion engine driving the chain saw and a tank housing 3 which comprises a fuel tank 4 having flanges 5 and 6 which are preferably formed on the housing so that the flanges and tank define a single unit. As can be especially seen in FIG. 3, the flanges 5 and 6 have a width B which corresponds approximately to the width B' of the crankcase 2. The fuel tank 4 is configured with respect to its width to correspond to the width B of the flange. The tank housing is preferably produced as a single piece made of plastic whereas the crankcase is cast from a magnesium alloy.

The tank housing 3 (with its flanges 5 and 6 facing the crankcase 2) is joined to the crankcase 2 in the direction of arrow P as shown in FIG. 2. The assembly and configuration of the crankcase as well as the flanges is so made that even a lateral joining of crankcase 2 and tank housing 3 in the direction of arrow P* is possible as shown in FIG. 3.

Figure 4:
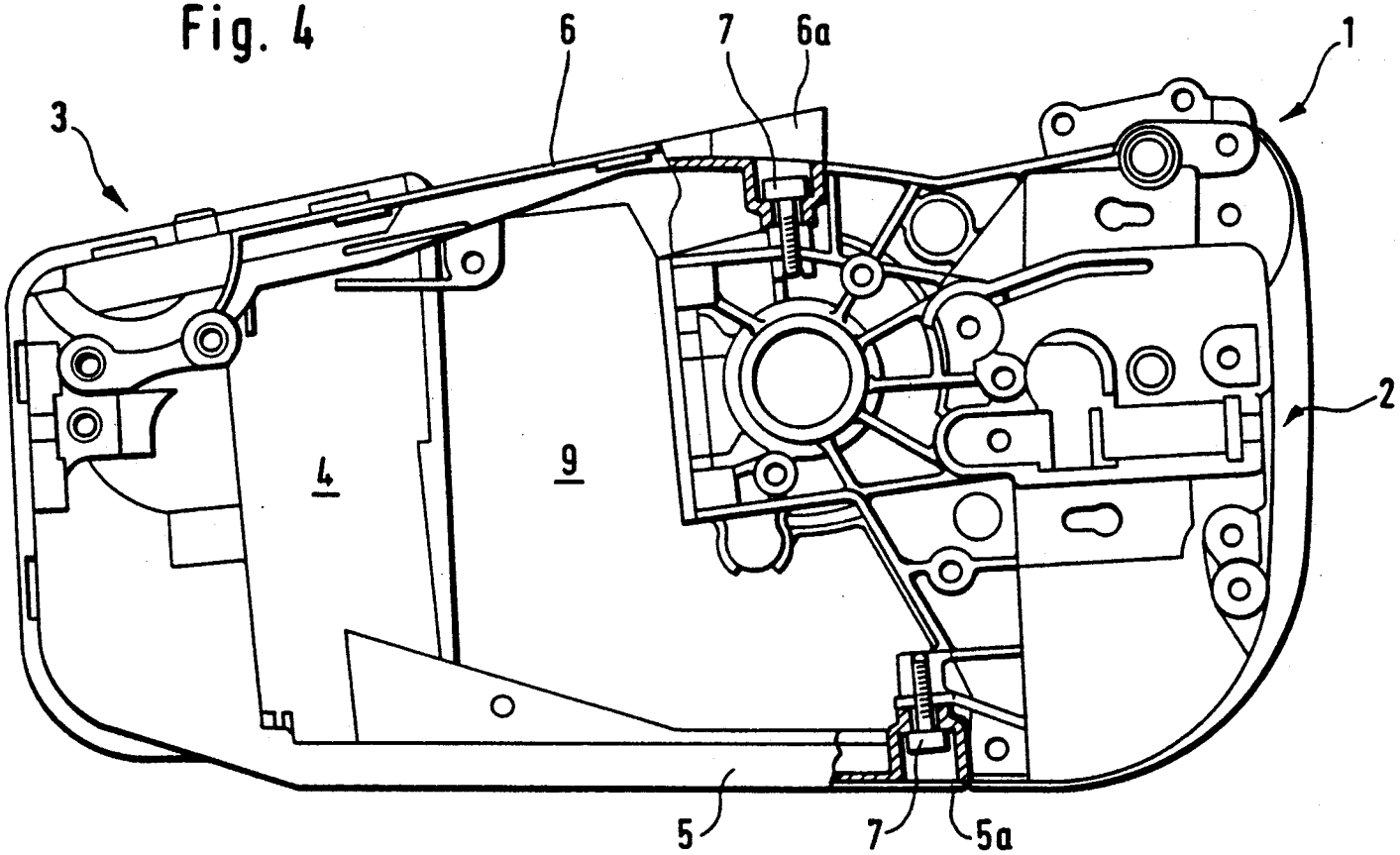
FIG. 4 is a side elevation view of the apparatus housing wherein the crankcase and the tank housing have been joined; and, FIG. 5 is side elevation view of an apparatus housing having a fan housing mounted thereon.

Independently of the direction of assembly according to arrow P (FIG. 2) and arrow P* (FIG. 3), the free ends (5*a*, 6*a*) of the flanges (5, 6) are preferably releasably attached to the crankcase 2 by means of screws 7 (FIG. 4). In the embodiment shown, the free end (5*a*, 6*a*) of each flange (5, 6) is attached by means of two screws 7 which lie transversely to the longitudinal direction of the apparatus housing 1 with a spacing relative to each other.

The base body of the apparatus housing 1 is in this way defined by the crankcase 2 as well as by the tank housing 3. The flanges 5 and 6 are directed from the tank 4 toward the crankcase 2 and define together with the crankcase 2 and tank 4 a mounting space 9 for accommodating additional components of the chain saw. For example, the mounting space 9 can accommodate the cylinder 10 (FIG. 1), the exhaust-gas muffler 11, et cetera. The flanges 5 and 6 define lower and upper housing sections, respectively.

Figure 5:
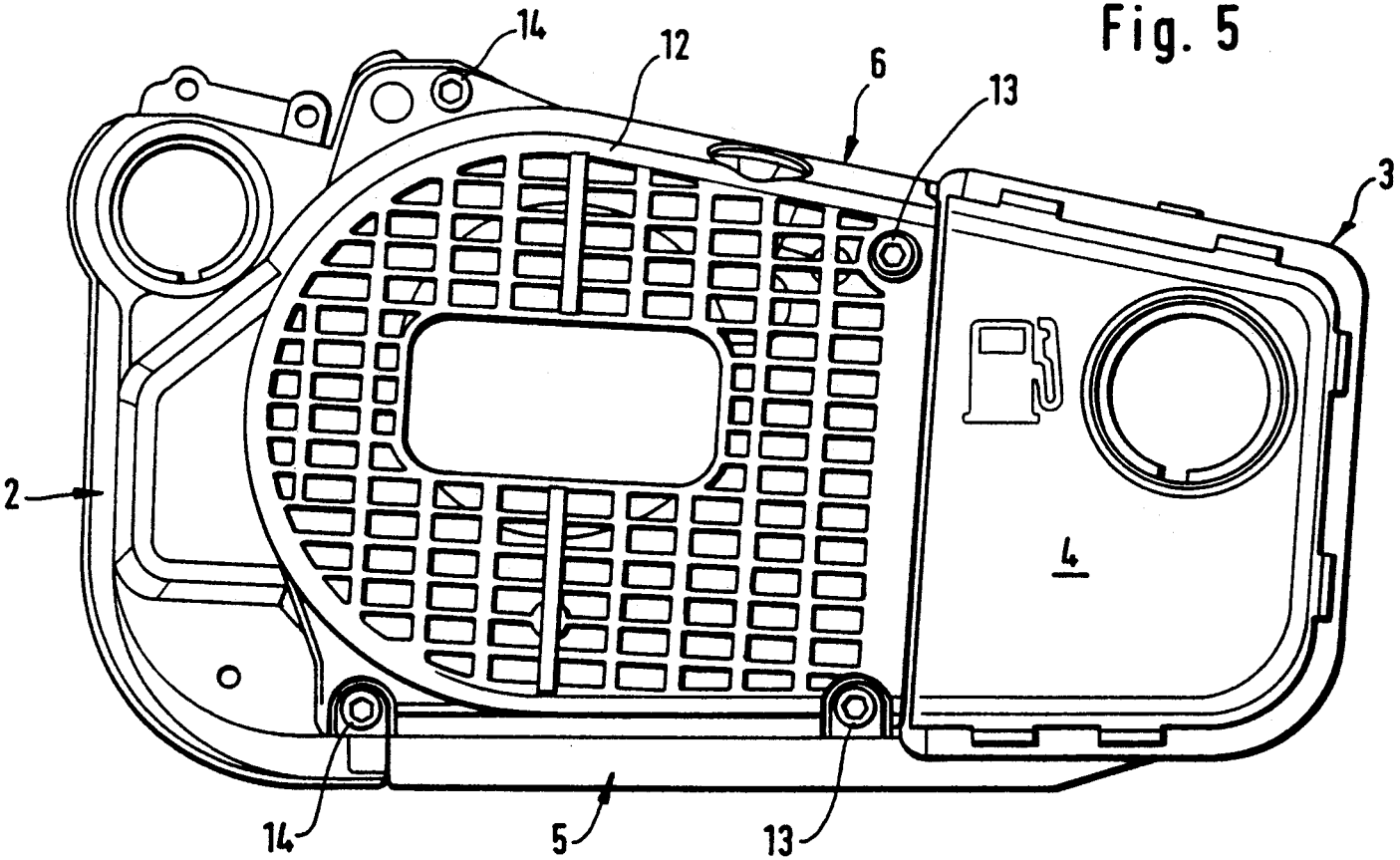

The mounting space 9 is further delimited by lateral cover plates. As shown in FIG. 5, one cover plate is defined by the fan housing 12 (FIG. 5) which, on the one hand, is fastened by screws 13 to the tank housing (fastened to the tank or to the flanges 5 and 6) and, on the other hand, is attached by screws 14 to the crankcase. The fan housing 12 covers not only the mounting space 9 but also further reinforces the apparatus housing 1 because of the nature of its attachment.

Cover plates (15, 16) fixed on the crankcase 2 are provided on the side facing away from the fan housing 12. The cover plates (15, 16) contribute to conducting the wanted cooling air. The cover plates 15 and 16 are preferably configured as two parts in order to make it possible to disassemble the muffler without disassembling the coupling lying on the outside. The cover plates 15 and 16 are attached to the crankcase 2 and lie against the tank housing component portions 17 and 18 as shown in FIG. 1 so that the cover plates contribute to this extent also to a reinforcement or stiffening of the housing. The lower cover plate 15 is made of plastic and covers the lower region of the crankcase as well as a portion of the mounting space 9 up to approximately where the cylinder 10 begins. The cover plate 15 reaches up to about half the length of the lower flange 5. The upper cover plate covers essentially a crankcase portion and projects with its portion 18 up to almost below the free end 6*a* of the upper flange 6.

The side of the apparatus housing 1 (FIG. 1) facing away from the fan housing 12 is closed by a sprocket cover not shown in greater detail wherein a chain braking arrangement is arranged which can be released via a guard lever 19.

The guard lever 19 lies in front of a single handle 20 of the motor-driven chain saw. The handle 20 is attached with its forward end 21 to the crankcase 2 and with its rearward end 23 to the tank housing 3, that is, on the fuel tank 4. The handle 20 then extends over the entire length of the apparatus housing 1 and is preferably connected to the crankcase 2 and tank housing 3 at respective ends of the handle 20 by means of vibration dampers of which only one vibration damper 24 is shown.

Operator-actuated elements for the engine, namely, the throttle lever 26 and the throttle lever lock 27 as well as an operating-mode selector 28 are mounted on the forward portion of the handle 20. The operating-mode selector 28 enables the operator to select a setting of stop, operating and start modes.

A carburetor (not shown) is mounted in the rearward handle portion 29 which is connected via an intake elbow to the cylinder 10. The carburetor chamber arranged in the rearward handle portion 29 is closed by an air-filter cover 30.

The modular assembly of the apparatus housing facilitates a simple and cost-effective exchange of defective components while at the same time providing an optimal use of space.

It is understood that the foregoing description is that of the preferred embodiments of the invention and that various changes and modifications may be made thereto without departing from the spirit and scope of the invention as defined in the appended claims.

What is claimed is:

1. A portable handheld work apparatus such as a motor-driven chain saw, the work apparatus comprising:

an internal combustion engine having a crankcase and at least one cylinder;

a fuel tank;

two flanges extending from said tank and being separated from each other by a predetermined spacing for attaching said fuel tank to said crankcase to define an apparatus housing and so as to cause said fuel tank, said crankcase and said flanges to conjointly define a mounting space for accommodating said cylinder therein; and, cover plates attached to said housing for at least partially closing said mounting space.

2. The portable handheld work apparatus of claim 1, said cover plates being attached to said crankcase and said fuel tank.

3. The portable handheld work apparatus of claim 1, said cover plates being attached to said flanges.

4. The portable handheld work apparatus of claim 1, said flanges being upper and lower portions of said housing.

5. The portable handheld work apparatus of claim 1, said cover plates defining lateral sections of said housing.

6. The portable handheld work apparatus of claim 1, one of said cover plates defining a fan housing.

7. The portable handheld work apparatus of claim 1, said flanges being integral with said fuel tank; and, said flanges and said fuel tank conjointly defining a one-piece tank housing.

8. The portable handheld work apparatus of claim 7, said tank housing being made of plastic.

9. The portable handheld work apparatus of claim 1, the work apparatus further comprising a handle having first and second ends attached to said crankcase and said fuel tank, respectively.

10. The portable handheld work apparatus of claim 9, the work apparatus further comprising a first vibration damper interposed between said first end and said crankcase and a second vibration damper interposed between said second end and said fuel tank.

11. The portable handheld work apparatus of claim 1, said crankcase being made of a magnesium alloy.

12. The portable handheld work apparatus of claim 1, further comprising removable fastener means for fastening said flanges to said crankcase.

* * * * *